US006544306B2

(12) United States Patent
Suzuki et al.

(10) Patent No.: US 6,544,306 B2
(45) Date of Patent: Apr. 8, 2003

(54) ABRASIVE PRODUCT AND METHOD OF MAKING THE SAME

(75) Inventors: Kazuo Suzuki, Sagamihara (JP); Fujio Hara, Hachioji (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/008,097

(22) Filed: Nov. 13, 2001

(65) Prior Publication Data

US 2002/0116876 A1 Aug. 29, 2002

(51) Int. Cl.[7] ..... B24D 11/00; B24D 11/02; B24D 18/00; B24D 3/00

(52) U.S. Cl. ..... 51/298; 51/295; 51/297; 51/307; 51/308; 51/309

(58) Field of Search ..... 51/295, 297, 298, 51/307, 308, 309

(56) References Cited

U.S. PATENT DOCUMENTS

| | | | | |
|---|---|---|---|---|
| 3,246,430 A | | 4/1966 | Hurst | |
| 3,498,010 A | | 3/1970 | Hagihara | |
| 3,609,925 A | | 10/1971 | Comella-Riera | |
| 3,869,263 A | | 3/1975 | Greenspan | |
| 4,142,334 A | | 3/1979 | Kirsch et al. | |
| 4,974,369 A | | 12/1990 | Dixon | |
| 4,997,717 A | | 3/1991 | Rembold et al. | |
| 5,014,468 A | | 5/1991 | Ravipati et al. | |
| 5,015,266 A | | 5/1991 | Yamamoto | |
| 5,147,416 A | | 9/1992 | Ohishi | |
| 5,190,568 A | | 3/1993 | Tselesin | |
| 5,199,227 A | | 4/1993 | Ohishi | |
| 5,219,462 A | | 6/1993 | Bruxvoort et al. | |
| 5,314,512 A | | 5/1994 | Sexton | |
| 5,489,235 A | | 2/1996 | Gagliardi et al. | |
| 5,643,343 A | * | 7/1997 | Selifanov et al. | 51/295 |

FOREIGN PATENT DOCUMENTS

| | | | |
|---|---|---|---|
| DE | 2650942 A1 | * | 5/1978 |
| JP | 63-16980 | | 1/1988 |
| JP | 2001-113467 | | 4/2001 |
| WO | WO 95/00295 | | 1/1995 |

OTHER PUBLICATIONS

Patent Abstracts of Japan, vol. 2000, No. 10, 2000198072 A, Jul. 18, 2000.

Patent Abstracts of Japan, vol. 010, No. 249, JP 61079576 A, Apr. 23, 1986.

* cited by examiner

*Primary Examiner*—Michael Marcheschi
(74) *Attorney, Agent, or Firm*—Richard Francis

(57) ABSTRACT

The invention provides an abrasive product having a sheet-like backing including a plurality of concavoconvex portions, the backing also having a first major surface including convex portions and an opposite second major surface including concave portions opposite said convex portions. A coating of a binder is applied over the first major surface and the convex portions. A single layer of a plurality of substantially erectly oriented abrasive particles is bonded to the backing by the binder coating. The abrasive product is made by providing the backing as defined, coating the first major surface with an uncured composition which will cure to provide the binder, applying abrasive particles to the uncured composition coating with an electrostatic sprayer and curing the uncured composition to provide the binder coating.

9 Claims, 4 Drawing Sheets

ABRASIVE PRODUCT AND METHOD OF MAKING THE SAME

RELATED APPLICATION

This application claims priority from Japanese Application No. 357442/2000 filed Nov. 24, 2000.

FIELD OF INVENTION

The present invention relates to an abrasive product which may be in the form of a tape, and more specifically concerns an abrasive tape suitable for finishing processes for magnetic disks, precision apparatuses and precision parts.

BACKGROUND

When an abrasive product having a flat abrasive layer is used in an abrasive process, it may not be possible to obtain a stable abrasive effect and abrasive precision. This may be because debris (sometimes called "detritus") from wearing away of the abrasive product and the surface being abraded can be accumulated between the abrasive product and the surface of the article to be abraded, with the result that the surface being abraded may be scratched by the detritus and the detritus may adhere to the surface being abraded and cause degradation in the abrasive precision.

In order to solve this problem, a technique has been known in which convex bodies are formed on the surface of an abrasive product so that detritus particles are collected in the recesses between the bodies and thereby be removed.

For example, a slurry coating liquid, formed by mixing abrasive particles and a bonding agent serving as its binder, is uniformly applied to a surface of a backing film and this is dried and set at a proper temperature to form an abrasive layer. When the abrasive coating liquid is dried and evaporated during the drying and setting process, the solvent is evaporated with convection while the solid components are left, thereby convex bodies (Benard cells) are formed on the surface of the backing.

The spaces between the convex bodies collect detritus particles, thereby removing some of the detritus. However, in the abrasive layer obtained in this manner, shapes of the convex bodies are nonuniform and irregular; therefore, it may not be possible to carry out an abrasive process with high precision.

U.S. Pat. No. 5,147,416 (Ohishi) discloses an abrasive tape whose abrasive layer has a three-dimensional structure. This abrasive tape has a base material, a support layer formed on the base material and an abrasive layer applied on the support layer, and the support layer is formed to have uniform, regular convex surface portions. However, since the support layer is formed by molding and curing a liquid composition, unwanted deformations may occur due to contraction at the time of curing, making it difficult to provide uniform, regular convex surface portions. Moreover, the molded product of this type is susceptible to cracking due to a frictional force at the time of abrading, making it difficult to maintain uniform, regular convex surface portions during the abrasive process.

Japanese Laid-Open Patent Publication No. 63-16980 (Yamaguchi et al.) discloses an abrasive tape having an abrasive layer on the surface which include concavoconvex surface portions. A binder and abrasive grains are applied onto a film backing and, after having been dried, this is subjected to an embossing process by a roll having a concavoconvex pattern, and then subjected to a pressing process by using a calendar roll with a concavoconvex printing plate cylinder. The concavoconvex pattern thus formed is comparatively uniform and regular, which makes it possible to carry out an abrasive process with high precision. Moreover, this product has high strength, is superior in the shape-retaining stability, and also has high cleaning effect. However, these concavoconvex portions are formed by pressing the surface of the abrasive layer using a roll. For this reason, the longer dimension of the abrasive grains are deployed parallel with the surface of the abrasive layer, and embedded therein, making the abrasive tape inferior in the abrasive performance. Moreover, it is difficult to apply the abrasive grains to the thin layer, and this method is inferior in the retaining force of the abrasive grains in use.

U.S. Pat. No. 5,015,266 (Yamamoto) discloses an abrasive tape in which a backing film having a concavoconvex pattern preliminarily formed by an embossing process is provided with abrasive grains bonded onto the surface thereof by a binder. However, in this abrasive tape, the coating method of the binder and the abrasive grain is by a slurry coating method, such as roll coating method, knife coating method, die coating method and reverse coating method. Therefore, in the same manner as described above, the longer dimension of the abrasive grains are deployed parallel with the surface of the abrasive layer, and embedded therein, making the abrasive tape inferior in the abrasive performance. Moreover, it is difficult to apply the abrasive grains to the thin layer, and this method is inferior in the retaining force of the abrasive grains in use.

Japanese Laid-Open Patent Publication No. 2001-113467 (Okawa et al.) discloses an abrasive tape in which a backing film having a concavoconvex pattern is provided with layer of binder and abrasive grains having a corresponding concavoconvex surface. However, in this abrasive tape, the coating method of the binder and the abrasive grain slurry is by roll coating. Furthermore, the abrasive coating comprises multiple layers of abrasive grains randomly embedded therein having a particle size between 0.1–0.8 $\mu$m. Therefore, the bulk of the abrasive grains are not deployed in an erect orientation with respect to the film plane, resulting in an abrasive tape having inferior abrasive performance.

SUMMARY OF THE INVENTION

The present invention has been devised to solve the above-mentioned conventional problems, and its objective is to provide an abrasive tape whose abrasive layer has a concavoconvex pattern that is superior in the uniformity, regularity and shape-retaining stability, and which is superior in the cleaning effect, abrasive precision, abrasive force and efficiency in using the abrasive grains.

The present invention in one aspect, provides an abrasive product comprising:

a. a sheet-like backing including a plurality of concavoconvex portions, said backing having a first major surface including convex portions and an opposite second major surface including concave portions opposite said convex portions;

b. a coating of a binder applied over the first major surface and the convex portions; and c. a single layer of a plurality of substantially erectly oriented abrasive particles bonded to the backing by the binder coating.

In a further aspect, the present invention provides a method of making an abrasive product comprising:

a. providing a sheet-like backing including a plurality of concavoconvex portions, said backing having a first major surface including convex portions and an opposite second major surface including concave portions opposite said convex portions;

b. coating the first major surface of the backing with an uncured composition which is curable to provide a binder, c. applying abrasive particles to the uncured composition coating with an electrostatic sprayer; and d. curing the uncured composition to provide the binder coating.

The term "concavoconvex portions" refers to portions of the backing which have been treated to have an other than flat surface having a plurality of convex portions on one surface, each of which has an opposite concave portion on the other surface.

The term "erectly oriented" refers to a characteristic in which the longer dimensions of at least some of the abrasive particles are oriented substantially perpendicular to the backing of the abrasive material. This allows at least a portion of the abrasive grains to protrude from the outermost surface of the abrasive layer.

DETAILED DESCRIPTION

Figure 1:
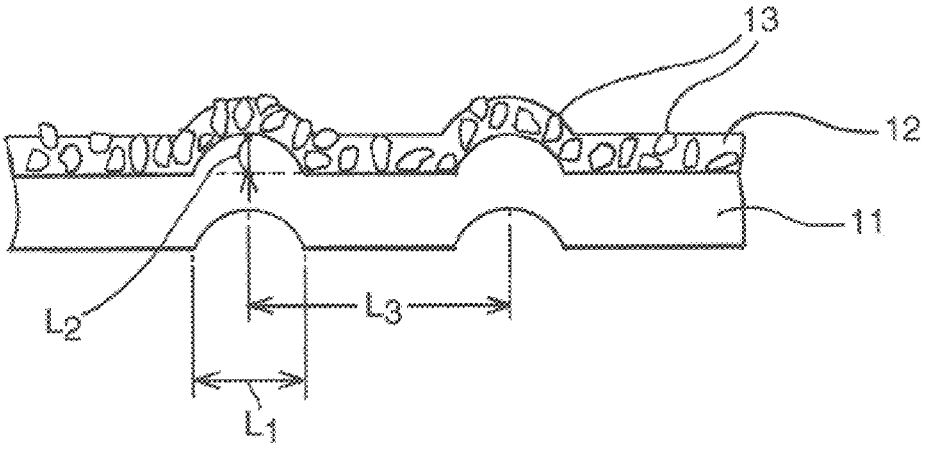
FIG. 1 is a schematic cross-sectional view that shows one embodiment of an abrasive tape in accordance with the present invention taken along line A–A' in FIG. 2.

FIG. 1 is a schematic cross-sectional view that shows one embodiment of an abrasive tape of the present invention. A film substrate or backing 11 is provided with concavoconvex portions formed on the surface thereof. The width $L_1$ of the protrusion is generally about 0.1 to about 1 mm, for example, about 0.5 mm, the height $L_2$ of the protrusion is generally about 10 to about 60 $\mu$m, for example, about 30 $\mu$m, and the pitch $L_3$ of the protrusion is generally about 0.5 to about 1.5 mm, for example, about 1 mm. These concavoconvex portions are formed so as to provide a cleaning effect to the surface of the abrasive tape, and they are preferably formed in a uniform manner in the manufacturing process of the film base material 11.

The concavoconvex portions are preferably formed by subjecting the film base material to an embossing process which preferably is a continuous process. Moreover, the concavoconvex portions may be formed by a replication method. These methods make it possible to form the concavoconvex portions regularly in a uniform manner, with high reproducibility, thereby the abrasive precision and finish of the abrasive tape are improved.

Figure 2:
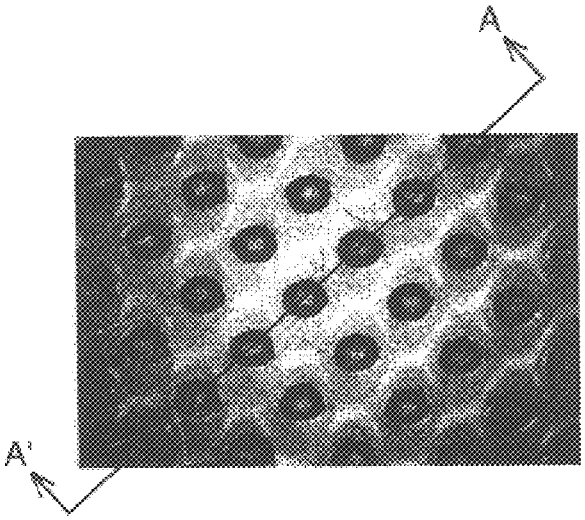
FIG. 2 is a plan view optical photomicrograph (magnification 12.5 ×) that shows a pin-point type concavoconvex portion pattern formed on the surface of a film base material.
Figure 3:
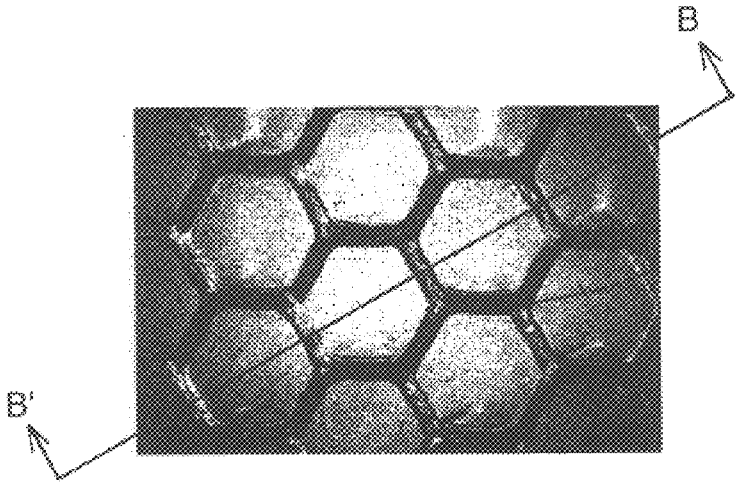
FIG. 3 is a plan view optical photomicrograph (magnification 10 ×) that shows a tortoise-shell type concavoconvex portion pattern formed on the surface of a film base material.

Examples of the concavoconvex portion pattern include a pin-point type pattern shown in FIG. 2 and a tortoise-shell type pattern shown in FIG. 3. With respect to the dimensions of the concavoconvex portion pattern of the pin-point type shown in FIG. 2, the A–A' cross-section thereof corresponds to the shape and dimension of the film base material 11 of FIG. 1.

Figure 4:
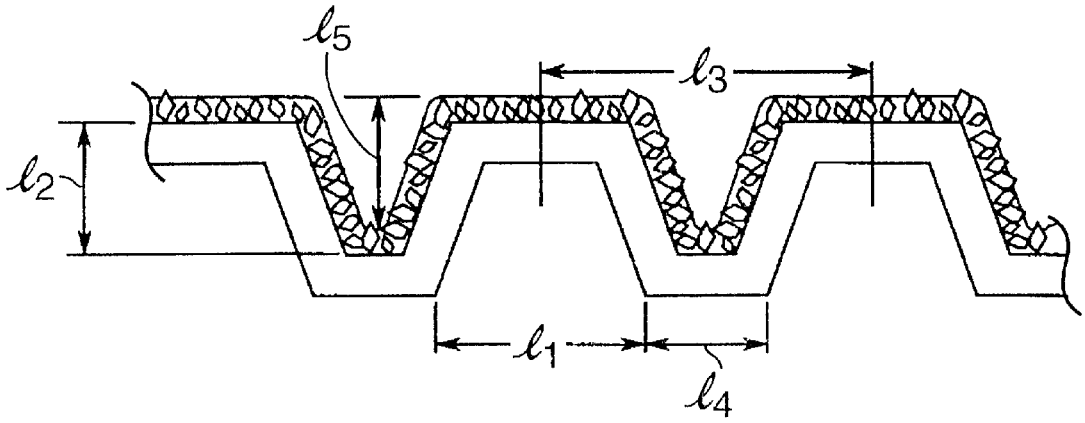
FIG. 4 is a schematic cross-sectional view taken along line B–B' of the tortoise-shell type concavoconvex portion pattern of FIG. 3

FIG. 4 is a schematic cross-sectional view taken along line B–B' in the tortoise-shell type concavoconvex portion pattern shown in FIG. 3. In FIG. 4, the width $l_1$ of the protrusion is generally about 1 to 5 mm, for example, 2 mm, the height $l_2$ of the protrusion is generally about 10 to 60 $\mu$m, for example, 30 $\mu$m, the pitch $l_3$ of the protrusion is generally about 1.1 to 5 mm, for example, 2.5 mm, the width $l_4$ of the recess is generally about 0.1 to 0.5 mm, for example, 0.2 mm, and $l_5$ is the depth of the groove in the top surface of the article shown in FIG. 4.

With respect to the material of the backing film, any polymeric is useful as long as it exerts high strength even when it is formed into thin film. More specifically, polyesters, such as polyethylene terephthalate, are preferred. The thickness of the backing film is generally about 10 to 150 $\mu$m, more preferably, 40 to 100 $\mu$m.

Abrasive grains 13 are bonded to the film base material by a binder 12. With respect to the binder, useful materials include those which provide sufficient bonding strength and are normally used in conventional abrasive tapes used for finishing processes of precision apparatuses and precision parts. Examples thereof include phenol resins, epoxy resins, polyester resins, urethane resins, acrylic resins, and the like.

With respect to the abrasive grains, useful abrasive grains include those normally used for conventional abrasive tape for use in finishing processes of precision apparatuses and precision parts. Examples of the material include aluminum oxide, cerium oxide, silicon carbide, diamond, fused alumina, and ceramic alumina-based materials such as those made by a sol gel process. The average particle size of the abrasive grains is preferable about 1 to about 30 $\mu$m.

The abrasive tape of the present invention is manufactured by applying the binder and the abrasive grains onto the first surface of the film base material having the convex surface portions. It is preferable to coat the surface of the film base material with the abrasive grains in the form of a single layer with the grains being aligned in one row. This structure provides higher retaining force of the abrasive grains and higher efficiency in the use of the abrasive grains in the abrasive tape, and it becomes possible to maintain the concavoconvex portion pattern on the surface of the film surface, as it is.

Figure 5A:
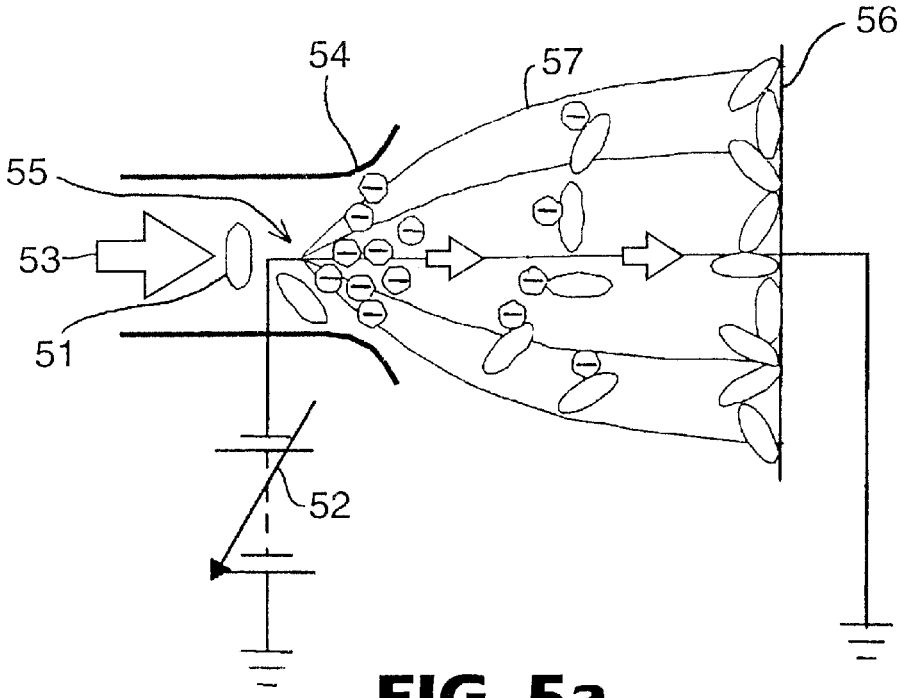
FIG. 5*a* is a schematic cross-sectional view that shows the principle of an electrostatic spray coating method.

It is preferable to apply the abrasive grains by using the electrostatic spray coating method. This method provides better orientation in the arrangement of the abrasive grains, and consequently improves grinding ratio of the abrasive tape. FIG. 5*a* is a schematic cross-sectional view that shows the principle of the electrostatic spray coating method. An object such as film backing 56 to be coated is placed in front of the spray nozzle 54 so as to face it with a predetermined gap. Abrasive grains 51 and a binder (not shown) are charged by a DC high-voltage power supply 52, and discharged through the nozzle 54 by using an air flow 53.

The abrasive particles 51 and the binder are allowed to adhere to the surface of the object to be coated (that is, a backing film of an abrasive tape) by a coulomb force derived from a corona discharging current flowing from a gun top needle electrode 55 having a high voltage to the surface of object 56 to be coated. In this method, an electrostatic field 57 is formed between the gun top needle electrode 55 and the object 56 to be coated so that the abrasive grains 51 ionized at the top of the electrostatic spray are allowed to fly along the electrostatic field 57 and to adhere to the surface of the object to be coated in a uniform manner.

Figure 5B:
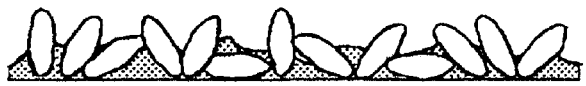
FIG. 5*b* is a schematic side view that shows a coated abrasive product made by the process depicted in FIG. 5*a*.

As a result, as illustrated in FIG. 5*b*, in comparison with the slurry method, a plurality of the abrasive grains on the surface of the film base material are oriented substantially erect, thereby making it possible to provide an abrasive tape that is superior in the abrasive force. Moreover, new abrasive grains no longer adhere to the abrasive grains that have already adhered because of an electrostatic repulsion so that the surface of the film base material is coated with the abrasive grains virtually in the form of a single layer; thus, it is possible to improve the retaining force of the abrasive grains and the efficiency in using the abrasive grains.

The binder and the abrasive grains may be applied separately, or as a mixture of the binder and the abrasive grains which had been previously prepared, and this mixture may be directly applied to the film base material by the electrostatic spray coating method.

After the abrasive grains and the binder have been applied to the film base material, the binder is cured to obtain an abrasive tape. The binder is generally cured by applying heat.

Additionally, with respect to the method for applying abrasive grains to a base material, other methods such as a slurry coating method and an electrostatic coating method similar to the electrostatic spray coating method have been conventionally known.

Figure 6A:
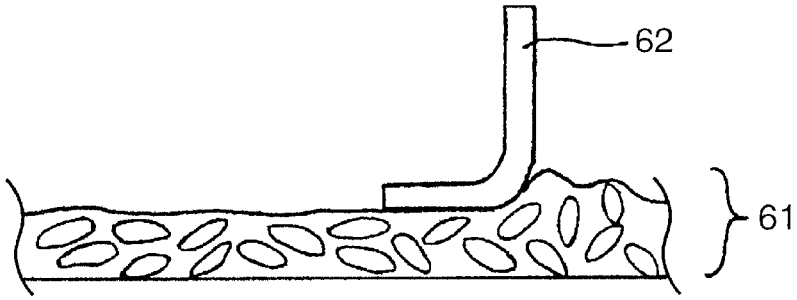
FIG. 6*a* is a schematic cross-sectional view that shows the principle of a slurry coating method of the prior art.
Figure 6B:
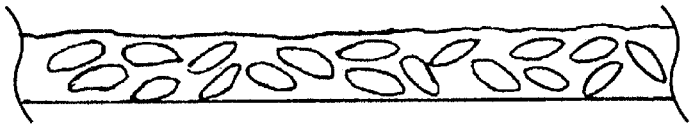
FIG. 6*b* is a schematic cross-sectional view that shows a coated abrasive product made by the process depicted in FIG. 6*a*.

FIG. 6*a* is a schematic cross-sectional view that shows the principle of a slurry coating method. A slurry coating liquid 61 containing abrasive grains and a binder is flattened by using a blade 62. As illustrated in FIG. 6*b*, in the slurry coating method, the longer dimension of an abrasive grain is deployed parallel with the surface of the abrasive layer rather than erectly deployed. Moreover, it is difficult to apply the abrasive grains in the form of a single layer. Consequently, the resulting abrasive tape is inferior in the abrasive force, retaining force and efficiency in using the abrasive grains.

Figure 7A:
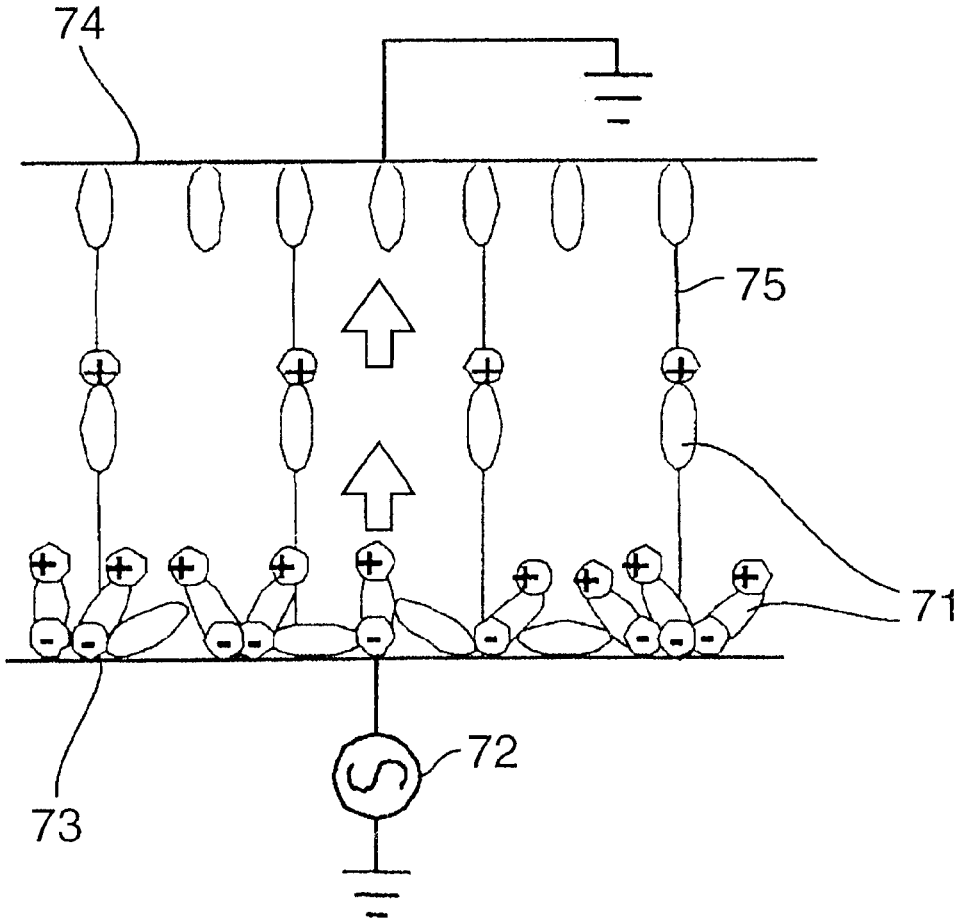
FIG. 7*a* is a schematic cross-sectional view that shows the principle of an electrostatic coating method of the prior art.

FIG. 7*a* is a schematic cross-sectional view that shows the principle of a conventional electrostatic coating method. Abrasive grains 71 are placed on a hot plate 73 and aligned to face to face with an object 74 to be coated with a predetermined gap. A voltage is applied to the hot plate 73 by an AC high-voltage power supply (2.5 to 60 Hz, 0 to 60 kV) 72 so that the abrasive grains 71 are charged. Simultaneously, an electrostatic field 75 is formed between the hot plate 7 1 and the object 74 to be coated so that the abrasive grains 72 are attracted toward the surface of the object 74 to be coated by a coulomb force and allowed to adhere thereto.

Figure 7B:
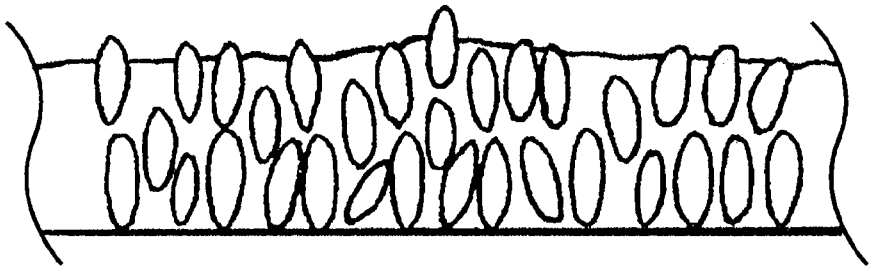
FIG. 7*b* is a schematic cross-sectional view that shows a coated abrasive product made by the process depicted in FIG. 7*a*.

In the electrostatic coating method, the orientation of the abrasive grains on the surface of the film base material is perpendicular to the surface of the abrasive layer. However, since the abrasive grains are charged by an AC power supply, one end of an abrasive grain is positively polarized and the other end is negatively polarized. For this reason, as illustrated in FIG. 7*b*, onto the abrasive grains that have adhered by an electrostatic attraction, abrasive grains are further allowed to adhere, with the result that the abrasive grains are applied in a multi-layered state. Consequently, the resulting abrasive tape is inferior in the retaining force and efficiency in using the abrasive grains.

EXAMPLES

The following examples will explain the present invention more specifically; however, the present invention is not particularly limited thereby.

Example 1

A polyethylene terephthlate (PET) film having a thickness of 3 mil (75 $\mu$m), which had a surface with concavoconvex portions, was prepared as a backing film. The concavoconvex portion pattern was a tortoise-shell type as shown in FIGS. 3 and 4, and formed by an embossing process. With respect to its dimensions, the width $l_1$ of the protrusion was 2 mm, the height $l_2$ of the protrusion was 30 $\mu$m, the pitch $l_3$ of the protrusion was 2.5 mm, and the width $l_4$ of the recess was 0.2 mm.

Next, an abrasive coating liquid, which was a mixture of abrasive grains and a binder, was prepared by mixing 100 g of JIS grade 2500 silicon carbide particles made by Nankou Ceramics k.k., Japan, 20 g of epoxy resin available under the trade name "EPOTOTO YD 128R" made by Touto Kasei k.k., Japan, 20 g of a polyamide curing agent available under the trade name "VERSAMID 125" made by Henschel Hakusui k.k., Japan, and 75 g of propylene glycol monomethyl ether made by Dow Corning, Ltd., and this was applied to the surface of the PET film through the electrostatic spray coating method.

Figure 8:
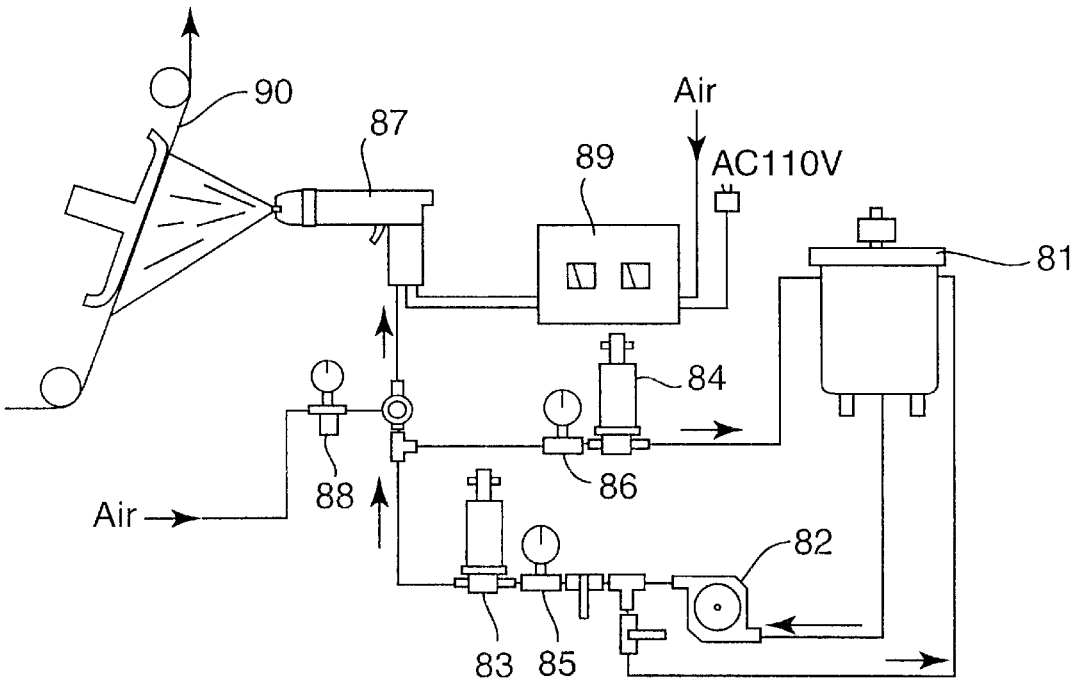
FIG. 8 is a schematic drawing that shows a coating device using the electrostatic spray coating method.

FIG. 8 shows a schematic drawing that shows the elements of a coating device used in the electrostatic spray coating method. The coating liquid was sent under pressure from a hold tank 81 equipped with an air mixer to a diaphragm pump 82, and circulated through a pressure differential between a paint regulator 83 and a back pressure regulator 84, and this pressure differential was held at not less than 150 kPa measured on gauges 85 and 86.

The coating liquid, sent to an electrostatic spray gun 87, was adjusted in its amount of output by a precision paint regulator 88 placed at the inlet of the gun, and atomized by air, and a voltage was applied to the electrode of the gun by a low-voltage control device 89 so as to form an electrostatic field in between gun 87 and PET film 90. Further, the air was ionized at the top of the electrode so that the particles which had passed through the ionized area were negatively charged (−), and applied to PET film 90 in the direction of the electrostatic field.

With respect to the coating device, an electrostatic spray gun "REA-90 FOR 75785 SOLVENT-BASED PAINT" and a low-voltage control unit "9040 CASCADE LOW-VOLTAGE CONTROL UNIT," made by Lanzburg Industry Ltd., were used. The coating conditions were as follows:

TABLE 1

| | |
|---|---|
| Abrasive coating liquid viscosity | 12.5 cps (12.5 mPa.s) |

TABLE 1-continued

| | |
|---|---|
| Abrasive coating liquid amount of application | 65 mg/cm$^2$ (0.40 g/inch$^2$) |
| Plant air pressure | 600 kPa |
| Circulated pressure difference | 150 kPa |
| Regulator pressure | 15 kPa |
| Voltage | 70 Kv |
| Distance between electrodes | 550 mm |

Next, the object to be coated was held at 140° C. for three minutes so as to be cured.

A Schiefer abrasive test machine (available from Frazier Precision Company, Gaithersburg, Md.) was used to carry out an abrasive test on the resulting abrasive tape. The abrasive conditions are shown as follows (Table 2). The amount of abrasion (g) at the time when an object to be polished was rotated 3000 times was obtained as an evaluation value, and shown in Table 3.

TABLE 2

| | |
|---|---|
| Object to be polished 1 | Acrylic resin disc (Diameter 100 mm, Thickness 10 mm) |
| Object to be polished 2 | Copper disc (Diameter 100 mm, Thickness 2 mm) |
| Abrasive load | 4.5 kg |

Comparative Example 1

An abrasive sheet having the trade designation 401Q WETORDRY made by Minnesota Mining and Manufacturing Company was prepared. This abrasive paper was manufactured by applying abrasive grains to a base material without concavoconvex portions on the surface thereof through an electrostatic spray coating method. The JIS grade of the abrasive grains was 2500, and the material of the abrasive grains was silicon carbide.

This abrasive paper was subjected to an abrasive test in the same manner as Example 1. The resulting amount of abrasion is shown in Table 3.

Comparative Example 2

An abrasive coating liquid was prepared by mixing silicon carbide particles having a JIS grade of 2500 and an epoxy resin at a weight ratio of 4:1. The abrasive coating liquid was applied to a PET film having a thickness of 3 mil (75 $\mu$m) through a slurry coating method. The thickness of the coating was 13 $\mu$m. Next, the object to be coated was held at 140° C. for three minutes so as to be cured.

This abrasive paper was subjected to an abrasive test in the same manner as Example 1. The resulting amount of abrasion is shown in Table 3.

TABLE 3

| | Acrylic resin plate (g) | Copper plate (g) |
|---|---|---|
| Example 1 | 1.24 | 0.21 |
| Comparative Example 1 | 0.78 | 0.09 |
| Comparative Example 2 | 0.03 | 0.03 |

It was possible to provide an abrasive tape whose abrasive layer had a concavoconvex pattern that was superior in the uniformity, regularity and shape-retaining stability, and which was superior in the cleaning effect, abrasive precision, abrasive force and efficiency in using the abrasive grains.

The present invention has now been described with reference to several embodiments thereof It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

What is claimed is:

1. An abrasive product comprising:

a. a plastic film backing including a plurality of concavoconvex portions, said backing having a first major surface including convex portions and an opposite second major surface including concave portions opposite said convex portions;

b. a coating of a binder applied over the first major surface and the convex portions; and c. a single layer of a plurality of erectly oriented abrasive particles bonded to the backing by the binder coating.

2. The abrasive product of claim 1 wherein said backing comprises an embossed plastic film.

3. The abrasive product of claim 1 wherein said concavoconvex portions comprise a uniform pattern.

4. The abrasive product of claim 1 wherein said abrasive particles have an average particle size of about 1 to about 30 $\mu$m.

5. The abrasive product of claim 1 wherein the backing has a thickness of less than 150 $\mu$m.

6. A method of making an abrasive product comprising:

a. providing a plastic film backing including a plurality of concavoconvex portions, said backing having a first major surface including convex portions and an opposite second major surface including concave portions opposite said convex portions;

b. coating the first major surface of the backing with a mixture of an uncured composition which is curable to provide a binder and abrasive particles with an electrostatic sprayer; and c. curing the uncured composition to provide an abrasive coating comprising a single layer of a plurality of erectly oriented abrasive particles bonded to the backing by the binder coating.

7. The method of claim 6 wherein said backing comprises and embossed plastic film.

8. The method of claim 6 wherein said abrasive particles have an average particle size of about 1 to about 30 $\mu$m.

9. The method of claim 6 wherein said backing has a thickness of less than 150 $\mu$m.

* * * * *